US011434596B2

(12) United States Patent
Ohyagi et al.

(10) Patent No.: US 11,434,596 B2
(45) Date of Patent: Sep. 6, 2022

(54) DRUM TYPE WASHING MACHINE AND CONTROL METHOD THEREOF

(71) Applicant: Samsung Electronics Co., Ltd., Suwon-si (KR)

(72) Inventors: Atsushi Ohyagi, Yokohama (JP); Takehiro Nakanishi, Yokohama (JP); Tomoyuki Okuno, Yokohama (JP); Yasushi Urai, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 22 days.

(21) Appl. No.: 17/096,401

(22) Filed: Nov. 12, 2020

(65) Prior Publication Data

US 2021/0148036 A1 May 20, 2021

(30) Foreign Application Priority Data

Nov. 20, 2019 (JP) ..... JP2019-209691
Sep. 8, 2020 (JP) ..... JP2020-150524
Oct. 21, 2020 (KR) ..... 10-2020-0136799

(51) Int. Cl.
*D06F 37/30* (2020.01)
*D06F 37/40* (2006.01)
(Continued)

(52) U.S. Cl.
CPC ..... *D06F 37/40* (2013.01); *D06F 33/40* (2020.02); *D06F 37/04* (2013.01); *D06F 2105/48* (2020.02)

(58) Field of Classification Search
CPC ..... D06F 37/40
See application file for complete search history.

(56) References Cited

U.S. PATENT DOCUMENTS 4,059,975 A * 11/1977 Jacobs ..... D06F 37/40 68/133
2015/0121630 A1* 5/2015 Lee ..... D06F 33/32 68/12.04
(Continued)

FOREIGN PATENT DOCUMENTS

CN 208791999 U 4/2019
JP S60-129083 A 7/1985
(Continued)

OTHER PUBLICATIONS

International Search Report dated Feb. 22, 2021, issued in International Application No. PCT/KR2020/015758.

*Primary Examiner* — Jason Y Ko
(74) *Attorney, Agent, or Firm* — Jefferson IP Law, LLP

(57) ABSTRACT

A drum type washing machine capable of realizing weight reduction and improvement in washing performance at low cost is provided. A drum type washing machine is disclosed. A pulsator is installed rotatably at a bottom of the drum rotatably accommodated in a tub. A motor configured to rotate forward and backward rotationally drives the drum and the pulsator. A control device executes a washing mode in which the motor is driven at a low rotation and a spinning mode in which the motor is driven at a high rotation. The pulsator and the drum have different velocity ratios. A second drive transmission element of the pulsator includes a clutch. Based on executing the washing mode, the drum is rotationally driven while the pulsator is rotationally driven or is allowed to idle. Based on executing the spinning mode, the drum is rotationally driven while the pulsator is allowed to idle.

17 Claims, 12 Drawing Sheets

(51) Int. Cl.

| | |
|---|---|
| ***D06F 33/40*** | (2020.01) |
| ***D06F 37/04*** | (2006.01) |
| *D06F 105/48* | (2020.01) |

(56) References Cited

U.S. PATENT DOCUMENTS

| | | | |
|---|---|---|---|
| 2018/0187359 | A1 | 7/2018 | Hirota et al. |
| 2019/0017210 | A1 | 1/2019 | Han et al. |

FOREIGN PATENT DOCUMENTS

| | | | |
|---|---|---|---|
| JP | 07204400 | A | 8/1995 |
| JP | 2017-012323 | A | 1/2017 |
| JP | 2018-033512 | A | 3/2018 |
| KR | 10-1995-0007852 | B1 | 7/1995 |
| KR | 10-0853665 | B1 | 8/2008 |
| WO | 2018/034432 | A1 | 2/2018 |

* cited by examiner

DRUM TYPE WASHING MACHINE AND CONTROL METHOD THEREOF

CROSS-REFERENCE TO RELATED APPLICATION(S)

This application is based on and claims priority under 35 U.S.C. § 119(a) of a Japanese patent application number 2019-209691, filed on Nov. 20, 2019, in the Japanese Patent Office, of a Japanese application number 2020-150524, filed on Sep. 8, 2020, in the Japanese Patent Office, and of a Korean patent application number 10-2020-0136799, filed on Oct. 21, 2020, in the Korean Intellectual Property Office, the disclosure of each of which is incorporated by reference herein in its entirety.

BACKGROUND

1. Field

The disclosure relates to a drum type washing machine provided with a pulsator at a bottom of a drum.

2. Description of Related Art

A drum type washing machine including a pulsator may have an effect of "scrubbing-washing" that alternately rubs laundry by a rotation of the pulsator, in addition to an effect of "beating-washing" that washes laundry by a mechanical action of lifting and dropping the laundry by a rotation of a drum. Therefore, the drum washing machine including the pulsator may have a better cleaning effect than a drum type washing machine without a pulsator.

However, in a case of such a drum type washing machine, it is required to rotationally drive the drum and the pulsator independently of each other. The drum is required to have a high-power driving force corresponding to a wide range of high torque low rotation and low torque high rotation, respectively, during washing and spinning. On the other hand, the pulsator is not required to have a high-power driving force corresponding to the wide range as large as the drum, but the pulsator is required to have a rotational speed or a rotation different from the drum.

In order to cope with the driving characteristics such as a wide area and high power and complex rotation characteristics, two motors are used in a drum type washing machine of Patent Document 1. Particularly, two motors are installed in a tub, and each motor is connected to a drum and a pulsator, respectively, through a pulley and a belt.

In Patent Document 2 regarding the disclosed technique, a washing machine using a clutch as a fan of a motor is disclosed.

Patent Document 3 discloses a technique for preventing locking of a drive motor due to entanglement of laundry in a drum-type washing machine equipped with a pulsator at the bottom of the drum. In washing or rinsing process of this drum-type washing machine, the drive motor is controlled in such a way that a pulsator (rotating blade) is rotated in the same direction at a speed higher than the drum and a rotation direction thereof alternately changes by using a clutch mechanism.

In this technology, a current value input to the drive motor is monitored during operation, and thus in response to the current value exceeding a threshold value (a current value increased due to cloth entanglement), it is configured to execute a predetermined entanglement loosening operation.

RELATED ART DOCUMENT (Patent Document 1) WO2018034432 A1
(Patent Document 2) JP1985129083 A
(Patent Document 3) JP2018033512 A The above information is presented as background information only to assist with an understanding of the disclosure. No determination has been made, and no assertion is made, as to whether any of the above might be applicable as prior art with regard to the disclosure.

SUMMARY

In the case of the drum type washing machine of Patent Document 1, because two motors are used, it is required to separately install a control system, and there are difficulties such as high manufacturing cost and heavy weight.

In addition, because such a motor is arranged in a position biased toward the rear of the tub, it is required to adjust a center of the tub by installing a heavy counterweight at the front of the tub. Due to such a counter weight, the drum type washing machine of Patent Document 1 further increases the weight and manufacturing cost.

Further, by providing a pulsator, washing performance is improved, but there is also a difficulty that laundry is easily tangled along with it. Based on entanglement of the laundry, there is a concern that the load of the motor increases and the motor is locked, as disclosed in Patent Document 3. In addition, even if the motor is not locked, power consumption increases and vibration or noise tends to increase.

On the other hand, because the current and load of the motor is already increased upon detecting the entanglement of laundry, as Patent Document 3, it is possible to prevent locking of the motor, but it may not cope with the difficulty in an increase in power consumption or vibration noise.

In order to suppress the increase in power consumption and vibration noise, it is required to perform a process such as loosening entanglement before the laundry starts to tangle. It is also possible to consider lowering the threshold, but in this case, malfunctions increase and thus the original control becomes difficult.

Aspects of the disclosure are to address at least the above-mentioned problems and/or disadvantages and to provide at least the advantages described below. Accordingly, an aspect of the disclosure is to provide a drum type washing machine capable of realizing weight reduction and improvement in washing performance at low cost.

Additional aspects will be set forth in part in the description which follows and, in part, will be obvious from the description, or may be learned by practice of the presented embodiments.

In accordance with an aspect of the disclosure, a drum-type washing machine is provided. The drum-type washing machine includes a body including an inlet configured to allow laundry to enter and exit and formed on a front side, a tub accommodated in the body and configured to store water, a drum rotatably installed inside the tub in such a way that an opening faces the inlet, a pulsator rotatably installed on a bottom of the drum, a motor configured to rotate forward and backward to rotationally drive the drum and the pulsator, a drive transmission device interposed between the drum and the pulsator, and the motor, and a control device configured to execute a washing mode in which the motor rotates at a low rotation, and a spinning mode in which the motor rotates at a high rotation.

The drive transmission device may include a first drive transmission element including a pulley connected to the drum and the motor, and a belt disposed around the pulley, and a second drive transmission element including a pulley connected to pulsator and the motor, and a belt disposed around the pulley, and configured to have a velocity ratio different from a velocity ratio of the first drive transmission element. The second drive transmission element may further include a clutch configured to transmit a driving force in one direction between forward rotation and reverse rotation while not transmitting a driving force in the other direction.

Based on executing the washing mode, the drum may be rotationally driven while the pulsator is rotationally driven or allowed to idle. Based on executing the spinning mode, the drum may be rotationally driven while the pulsator is allowed to idle.

The drum type washing machine may rotationally drive the drum and the pulsator by using a single motor, Therefore, in comparison with a case of using two motors, it is possible to reduce a control system and manufacturing cost. Further, it is possible to reduce a weight.

The motor may be configured to rotate forward and backward. The motor may further include a first drive transmission element configured to transmit a rotation of the motor to the drum and a second drive transmission element configured to transmit the rotation of the motor to the pulsator, configured to have a different velocity ratio. The second drive transmission element may further include a clutch. Accordingly, based on executing the washing mode requiring a low rotation and high torque, the drum may be rotationally driven while the pulsator is rotationally driven or allowed to idle. Based on executing the spinning mode requiring a high rotation and low torque, the drum may be rotationally driven while the pulsator is allowed to idle.

The clutch may have a simple structure and a cheap price in comparison with a speed reducer or transmission. Therefore, it is possible to reduce manufacturing cost and promote weight reduction.

Because the drum rotates to lift and drop laundry in the washing mode, it is possible to obtain an action of beating-washing, similar to the general drum type washing machine During the pulsator rotates, an action of scrubbing washing by the pulsator may be added. Therefore, the cleaning effect may be improved. Because the drum and the pulsator do not rotate only in the same direction, it is possible to prevent excessive mechanical action from being applied to the laundry. Further, it is possible to prevent entanglement of laundry.

In the execution of the spinning mode, the motor may be rotationally driven in a direction in which the driving force is not transmitted to the pulsator by the clutch. Accordingly, the drum may rotate, but the pulsator may idle. Therefore, because the driving force of the motor is used only in the drum, the load of the motor may be reduced, and thus the load may be managed by a single motor. Even if the laundry comes into contact with the pulsator, the pulsator may idle together with the clutch, and the pulsator may rotate in synchronization with the drum, and thus a strong force may not be applied on the laundry. Therefore, it is possible to prevent damage on the laundry.

It is appropriate that the velocity ratio is set to allow the pulsator to rotate at 75 to 250 rpm while the drum rotates at 50 rpm.

Two pulleys connected to the motor may be changeably fixed to a driving shaft of the motor.

Accordingly, the velocity ratio may be easily adjusted, and thus it has excellent versatility.

The drum-type washing machine may further include a heater configured to heat water stored in the tub upon executing the washing mode. It is appropriate that a current is applied to the heater during the pulsator is not rotationally driven, and the current is not applied to the heater during the pulsator is rotationally driven.

Because the heater heats water by increasing a temperature of water used for washing or rinsing, the cleaning effect may be enhanced. However, for heating water, it is required to supply a large current to the heater. The drum type washing machine may rotationally drive the drum and the pulsator by using a single motor, and thus the large amount of current may be supplied based on driving the drum and the pulsator to rotate. Particularly, based on starting the drum-type washing machine, the current may increase instantaneously because a load is applied to both sides at the same time.

Therefore, based on rotational driving in one direction with driving of the heater, the amount of current may increase at once and power may be insufficient. On the other hand, based on rotational driving in other direction opposite to the one direction, only the drum may rotate, and thus the amount of current required by the motor may be small. Therefore, the heater may be controlled to allow a current to be applied to the heater during the pulsator is not rotationally driven, and to allow the current not to be applied to the heater during the pulsator is rotationally driven. It is possible to prevent power consumption from exceeding the rated power. Therefore, it is possible to rotationally drive the drum and the pulsator by using a single motor while heating water.

The drum-type washing machine may temporarily reverse the rotation direction of the motor in the washing mode based on a drive current of the motor exceeding a predetermined value. Based on a drive current of the motor exceeding the predetermined value, the drum-type washing machine may temporarily increase the rotational speed of the motor.

In the washing mode, the drum-type washing machine may execute a first entanglement prevention control, in which the rotational speed of the motor is temporarily increased, based on a drive current of the motor exceeding the predetermined value. The drum-type washing machine may execute a second entanglement prevention control, in which the rotation direction of the motor is temporarily reversed, based on the drive current of the motor, which is not less than the predetermined value, in the first entanglement prevention control.

The drum-type washing machine may increase a mechanical action by including the pulsator, so as to increase the washing performance but it may lead to the entanglement of laundry. The entanglement of laundry may cause locking by laundry stuck between the drum and the pulsator. Because the drum-type washing machine drives both the drum and the pulsator by using the single motor, the motor is likely to be overloaded based on locking of the laundry.

A degree of load on the motor may be determined by the drive current of the motor. Thus, for example, by setting a drive current value (a drive current value for a certain period of time), in a state in which the load of the motor is higher than usual, as a determination reference value, it is possible to detect that the laundry is tangled.

Accordingly, based on increasing the rotational speed of the drum, the movement of the laundry in the drum changes, such as a drop position of the laundry. Therefore, in a case in which entanglement of laundry is relatively loose, the entanglement may be loosened. By temporarily reversing the rotation direction of the motor or temporarily increasing the rotational speed of the motor, the state of the laundry in the drum may greatly change. Accordingly, based on a state of laundry in which the entanglement of the laundry is moderate, the entanglement may be loosened. Therefore, it is possible to effectively prevent the entanglement of laundry, and to stably secure high washing performance.

In the washing mode, among two process such as a high load rotation process in which the drum rotates forward at a predetermined speed while the pulsator rotates at a speed higher than the drum, and a low load rotation process in which the drum rotates backward at the predetermined speed while the pulsator idles, the high load rotation process may be executed. It is possible to detect a precursor of overload of the motor based on a comparison value about an amount of change in the drive current of the motor measured over a predetermined period during the high-load rotation process. Based on detecting the precursor, the low load rotation process may be temporarily executed for a predetermined period.

In the drum type washing machine, the drum and the pulsator may rotate at different speeds in the same direction even during the high-load rotation process, in which the mechanical action is stronger than that of the low-load rotation process and the entanglement of laundry is likely to occur. Therefore, the mechanical action may be weak in comparison with the contra-rotation. Accordingly, the load on the motor may be relatively small, and the change may be also gentle. The condition of the laundry in the drum may be also relatively stable. Therefore, the entanglement of laundry also may tend to occur relatively loosely.

As a result of review by designers with focusing on this point, it is confirmed that a precursor of overload of the motor is detected based on a comparison value about an amount of change in the drive current of the motor measured over a predetermined period during the high-load rotation process. If it is possible to detect the precursor of overload of the motor, it is possible to prevent locking of motor, and prevent the increase in power consumption and vibration noise.

Particularly, it is possible to determine the presence or absence of a precursor of overload of the motor depending on whether any one of a first comparison value and a second comparison value exceeds a predetermined value, and the first comparison value may be obtained by averaging a drive current value in a predetermined period, and a second comparison value may be obtained by averaging an absolute value of a deviation of a drive current value in the predetermined period.

It is possible to determine the presence of the precursor of overload of the motor based on the first and second comparison value. Only one value may be used for the determination, but it is possible to more stably detect the precursor of the overload by combining both values.

It is appropriate that the predetermined period is set as a period in which the drum rotates 1 to 3 times.

Based on the number of rotations being less than once, it is greatly affected by the fluctuation of the instantaneous drive current value. Based on the number of rotations exceeding three times, a difference in the relationship between the change in the condition of the laundry and the comparison value may increase, and the detection accuracy may be degraded. Based on the predetermined period that is too short or too long, it is difficult to detect the precursor of overload of the motor.

In the washing mode, the high-load rotation process and the low-load rotation process may be alternately executed for a predetermined driving period. In this case, it is appropriate that a period for the high-load rotation process is set to be longer than a period for the low-load rotation process.

The overload of motor may likely occur in the execution of the high-load rotation process, and as the driving period is longer, it is possible to stably measure the amount of change in the drive current of the motor. Washing performance may be improved.

Based on terminating the temporary low-load rotation process during the driving period of the high-load rotation process, the high-load rotation process may be resumed.

The high-load rotation process is superior in the cleaning effect and thus the mechanical force is strong. Therefore, if it is possible to prevent the overload in advance through the temporary low-load rotation process, it is possible to prevent a decrease in the cleaning effect by resuming the high-load rotation process.

Other aspects, advantages, and salient features of the disclosure will become apparent to those skilled in the art from the following detailed description, which, taken in conjunction with the annexed drawings, discloses various embodiments of the disclosure.

The reference value may be pre set according to a test result.

The reference value may be changed based on a detected amount of laundry.

The amount of laundry may be detected using centrifugal force.

BRIEF DESCRIPTION OF THE DRAWINGS

The above and other aspects, features, and advantages of certain embodiments of the disclosure will be more apparent from the following description taken in conjunction with the accompanying drawings, of which.

The same reference numerals are used to represent the same elements throughout the drawings.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Configuration of Drum Type Washing Machine

Figure 1:
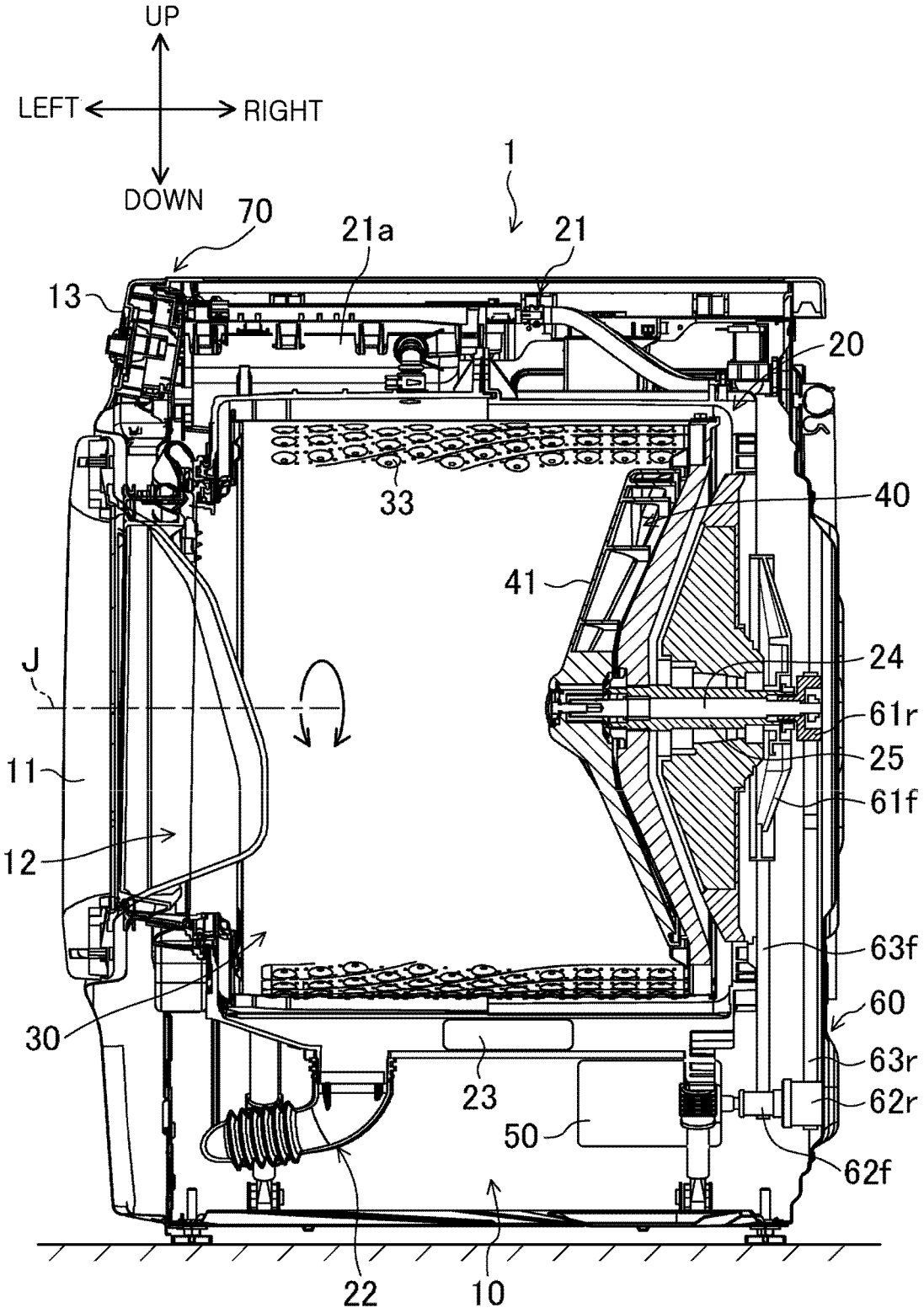
FIG. 1 is a schematic sectional view illustrating a structure of a drum type washing machine according to an embodiment of the disclosure.

FIG. 1 illustrates a drum type washing machine according to an embodiment of the disclosure.

Referring to FIG. 1, the washing machine 1 may include a body 10, a tub 20, a drum 30, a pulsator 40, a motor 50, a drive transmission device 60, and a control device 70.

In the washing machine 1, a washing mode corresponding to a process of washing laundry such as "washing" or "rinsing" and a spinning mode corresponding to a "dehydrating" process to remove water from wet laundry are automatically performed according to a set program (fully automatic).

(Body 10)

The body 10 includes a frame or a panel, and is formed in a box shape. A circular inlet 12 configured to be opened and closed by a door 11 is formed at approximately a center of the front of the body 10. Laundry is put into and taken out through the inlet 12. A manipulator 13 on which a switch or the like is disposed is installed on an upper front side of the body 10.

(Tub 20)

The tub 20 is formed with a cylindrical container having a bottom provided to store water. The tub 20 is installed in the inside of the body 10 in such a way that the tub 20 is laid on the side to allow an opening, which is formed on a front central portion of the tub 20, to communicate with the inlet 12. The tub 20 is supported by the body 10 through a damper or the like. In response to executing the washing mode, water is stored in a lower portion of the tub 20.

A water supply device 21 configured to supply water from an external water surface to the tub 20 via a pipe is installed above the tub 20 in an inside of the body 10. The water supply device 21 is provided with a detergent case 21*a* configured to accommodate a detergent or the like. By putting a detergent or a softener into the detergent case 21*a* before the washing machine 1 is operated, the detergent may be supplied to the tub 20 together with water during water supply.

A drainage device 22 configured to discharge unnecessary water is installed below the tub 20 in the body 10. In addition, in the washing machine 1, a heater 23 configured to heat water stored in the tub 20 is installed under the tub 20.

A cylindrical outer shaft 25 provided to extend in a front and rear direction while being aligned with a rotation axis J, and a cylindrical inner shaft 24 inserted to penetrate the outer shaft 25 are installed at the bottom of the tub 20 (double shaft structure). The inner shaft 24 and the outer shaft 25 penetrate through the bottom of the tub 20 and protrude forward and backward of the tub 20. The inner shaft 24 is longer than the outer shaft 25, and thus front and rear ends of the inner shaft 24 protrude outward of the outer shaft 25.

The inner shaft 24 and the outer shaft 25 are configured to be rotatable independently of each other. The outer shaft 25 is axially supported on the bottom of the tub 20 through a bearing. Accordingly, the inner shaft 24 and the outer shaft 25 may be rotated independently of each other with respect to the tub 20.

(Drum 30)

The drum 30 is formed with a bottomed cylindrical container including an opening at one end and a bottom at the other end. The drum 30 is formed slightly smaller than an inner dimension of the tub 20. The drum 30 is accommodated in the tub 20 in such a way that the opening faces the inlet and the bottom faces the rear. The drum 30 is rotatably supported by the tub 20.

A front end portion of the outer shaft 25 is fixed at the center of the bottom portion of the drum 30. Accordingly, a rear portion of the drum 30 is supported by the outer shaft 25, and thus the drum 30 is rotatable about the rotation axis J. A plurality of through holes 33 penetrating inside and outside a circumferential surface of the drum 30 is formed almost all over the circumferential surface of the drum 30 (FIG. 1 illustrates only a part thereof).

(Pulsator 40)

The pulsator 40 is formed of a disk-shaped member including an approximately conical surface. The pulsator 40 is installed at the bottom of the drum 30 while a surface thereof faces the inside of the drum 30. The pulsator 40 includes a plurality of protrusions 41 protruding on a surface thereof. The protrusions 41 extend radially outward in a radial direction from the center of the pulsator 40. A cross section of each protrusion 41 has a substantially trapezoidal shape.

A front end portion of the inner shaft 24 is fixed at the center of the pulsator 40. Accordingly, the pulsator 40 is rotatable about the rotation axis J.

(Motor 50)

A single motor 50 is installed below the rear end of the tub 20. The motor 50 is positioned so as to be substantially parallel to the rotation axis J while a drive shaft 51 of the motor 50 faces the rear side. The motor 50 is rotated under inverter control, and is configured to be rotatable in both forward and reverse directions.

Because the motor 50 uses a lot of iron, copper, aluminum, etc., the motor is heavy. Therefore, in response to installing the motor 50 at a deflected position of the rear portion of the tub 20, the center of the tub 20 is greatly deflected from the rotation axis J. Although not shown, a heavy counterweight is provided in the front portion of the tub 20 to adjust the center of the deflected tub 20.

In a case of including two motors 50, the counter weight may become heavier. Accordingly, the deflection of the center of the tub 20 is also increased, and the weight of the counterweight is also increased. On the other hand, because the washing machine 1 includes a single motor 50, it is possible to reduce a total weight of the washing machine 1. Further, because the number of control systems such as inverters is also reduced, it is possible to further reduce the weight of the washing machine 1 and it is possible to reduce member cost and assembly process.

Because the washing machine 1 rotationally drives both the drum 30 and the pulsator 40 by using the single motor 50, the performance of the motor 50 is set to correspond to this output. A maximum output of the motor 50 is smaller than a total value of maximum outputs of the two motors 50, and thus the weight of the washing machine 1 is reduced as much as a weight of a single motor.

(Drive Transmission Device 60)

The drive transmission device 60 is interposed between the drum 30 and the pulsator 40, and the motor 50. The drive transmission device 60 transmits a driving force output from the motor 50 to the drum 30 and the pulsator 40, respectively.

Figure 2:
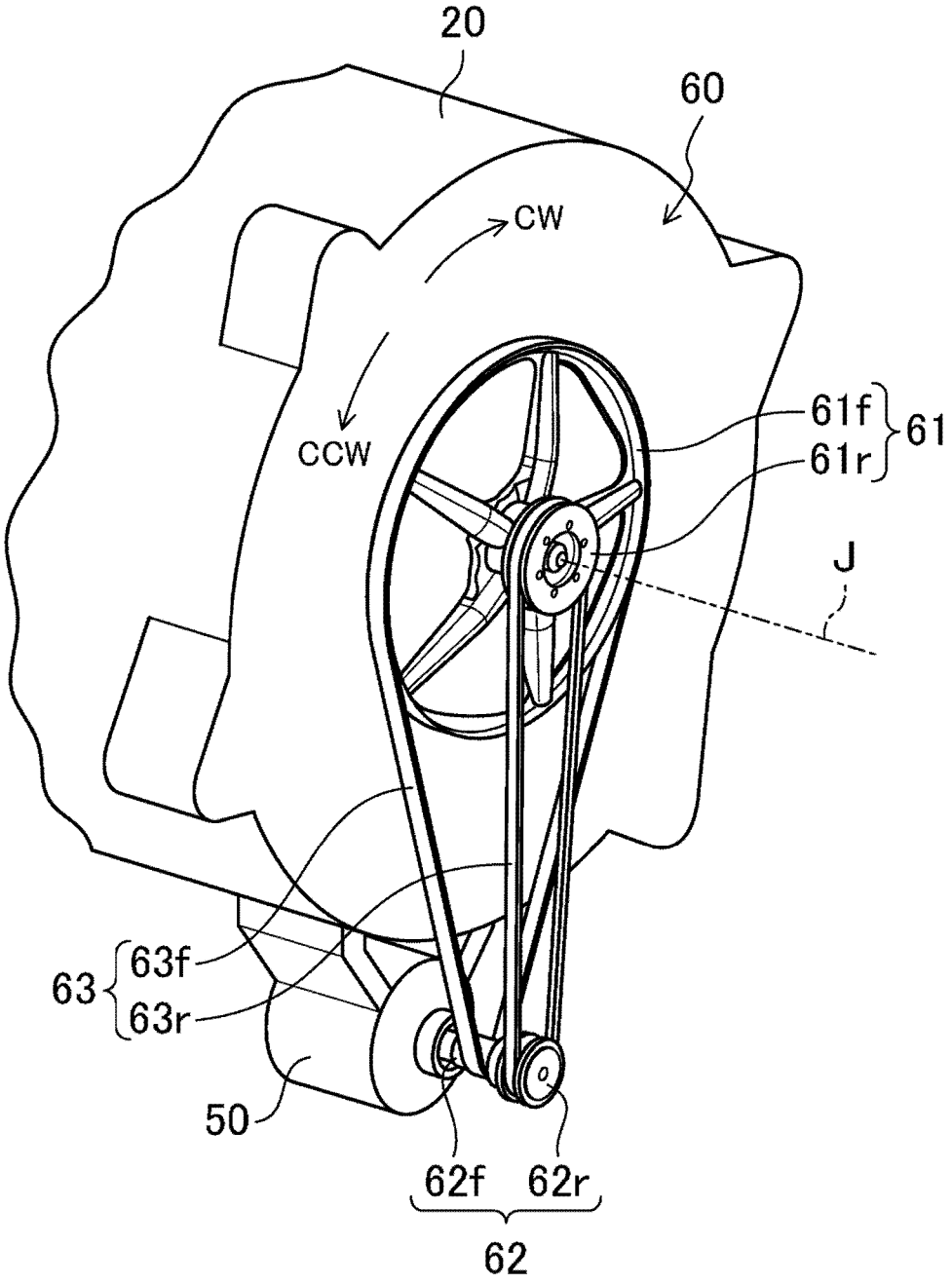
FIG. 2 is a schematic perspective view illustrating a drive transmission device according to an embodiment of the disclosure.

FIG. 2 is a schematic perspective view illustrating a drive transmission device according to an embodiment of the disclosure.

Referring to FIGS. 1 and 2, the drive transmission device 60 includes two pulleys (a driven pulley 61) disposed in the rear of the tub 20, two pulleys (a driving pulley 62) disposed below the driven pulley 61, and two belts 63 and 63 disposed around the pulley.

The two driven pulleys 61 and 61 are disposed adjacent to each other in the front and rear direction (a front driven pulley 61*f* and a rear driven pulley 61*r*). The front driven pulley 61*f* is a large-diameter pulley, and fixed to the rear end of the outer shaft 25. The rear driven pulley 61*r* is a small diameter pulley, and fixed to the rear end of the inner shaft 24. Accordingly, the front driven pulley 61*f* is connected to the drum 30 through the outer shaft 25, and the rear driven pulley 61*r* is connected to the pulsator 40 through the inner shaft 24.

Figure 3:
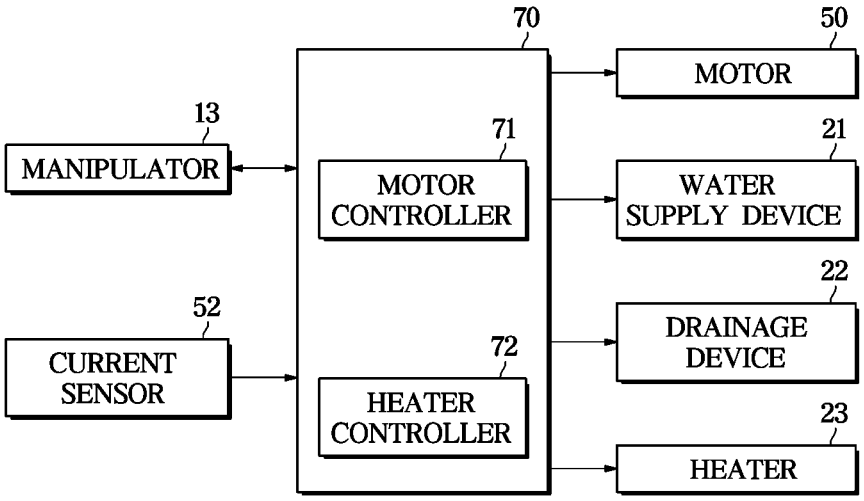
FIG. 3 is a schematic sectional view illustrating a main portion of the drive transmission device according to an embodiment of the disclosure.

FIG. 3 is a schematic sectional view illustrating a main portion of the drive transmission device according to an embodiment of the disclosure.

As enlarged and referring to FIG. 3, the two driving pulleys 62 and 62 are also disposed adjacent to each other in the front and rear direction (a front driving pulley 62*f* and a rear driving pulley 62*r*). The front driving pulley 62*f* is a small diameter pulley, and the rear driving pulley 62*r* is a pulley having a diameter slightly larger than that of the front driving pulley 62*f*. The front driving pulley 62*f* and the rear driving pulley 62*r* are detachably fixed to the drive shaft 51 of the motor 50, thereby being connected to the motor 50. It is appropriate that the driving pulleys 62*f* and 62*r* are configured to be separated and changed. Accordingly, a velocity ratio may be easily adjusted.

A clutch 64 (1-way clutch) is embedded in the rear driving pulley 62*r*. By the clutch 64, the rear driven pulley 61*r* is configured to transmit the driving force in the clockwise direction (CW direction), but not in the counterclockwise direction (CCW direction) when viewed from the rear. Because the clutch 64 is a known member, a detailed description thereof is omitted.

A front belt 63*f* in a ring shape is disposed around the front driving pulley 62*f* and the ring of front driven pulley 61*f*, and a rear belt 63*r* in a ring shape is disposed around the rear driving pulley 62*r* and the ring of rear driven pulley 61*r*. Accordingly, the driving force output from the motor 50 is transmitted to the drum 30 by the front driving pulley 62*f*, the front driven pulley 61*f*, and the front belt 63*f* (a first drive transmission element), and the driving force is transmitted to the pulsator 40 by the rear driving pulley 62*r*, the rear driven pulley 61*r*, and the rear belt 63*r* (a second drive transmission element).

The front driving pulley 62*f* has a smaller diameter than the front driven pulley 61*f*, and the rear driving pulley 62*r* has also a smaller diameter than the rear driven pulley 61*r*. Accordingly, both the first drive transmission element and the second drive transmission element decelerate the rotation output from the motor 50 and transmit the decelerated rotation to the drum 30 and the pulsator 40, respectively.

A velocity ratio of the first drive transmission element is different from a velocity ratio of the second drive transmission element. The velocity ratio of the first drive transmission element is greater than the velocity ratio of the second drive transmission element. Therefore, the drum 30 side is greatly decelerated than the pulsator 40 side. The drum 30 side may obtain a higher torque than the pulsator 40.

In this washing machine 1, in order to adequately respond to a broadband and high-power driving characteristics and complex rotation characteristics required for the drum 30 and the pulsator 40 by using the single motor 50, the velocity ratio is set to allow the pulsator 40 to rotate at 75~300 rpm while the drum 30 rotates at 50 rpm. For example, the velocity ratio on the drum 30 side may be about 1:10, and the velocity ratio on the pulsator 40 side may be about 1:2~4.

(Control Device 70)

The control device 70 is composed of hardware such as a CPU and memory, and software such as a control program. The control device 70 may include a processor. The control device 70 is installed in the upper portion of the body 10. The control device 70 comprehensively controls the washing machine 1 and automatically operates the washing mode and the spinning mode according to an instruction input to the manipulator 13.

Figure 4:
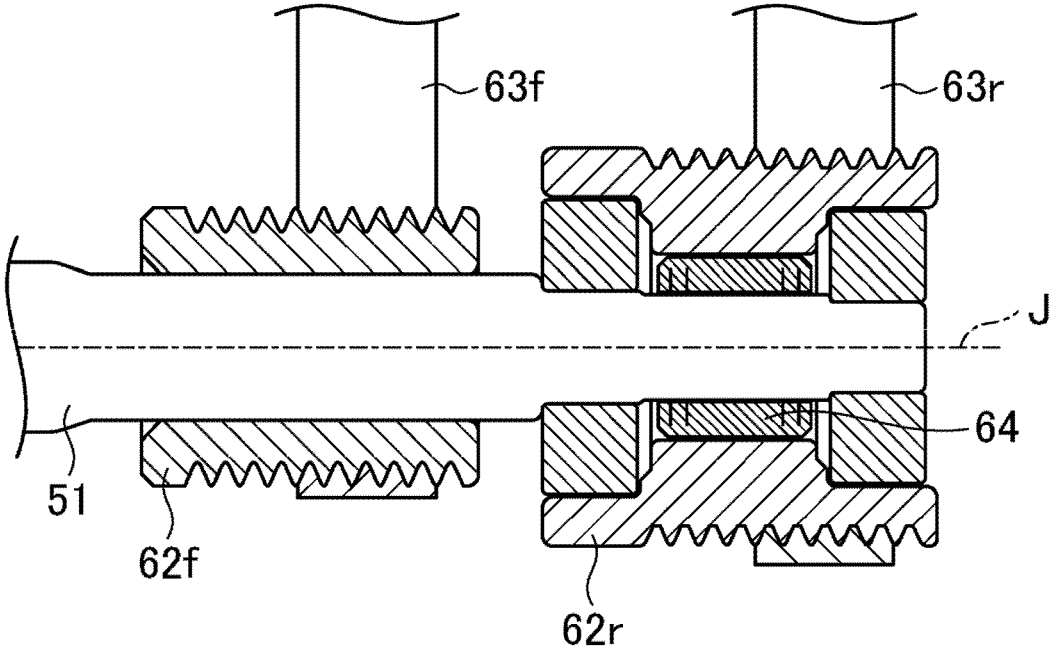
FIG. 4 is a block diagram illustrating a relationship between a control device and main equipment thereof according to an embodiment of the disclosure.

FIG. 4 illustrates a relationship between a control device and main equipment thereof according to an embodiment of the disclosure.

Referring to FIG. 4, the control device 70 is electrically connected to the manipulator 13, a current sensor 52, the motor 50, the heater 23, the water supply device 21, the drainage device 22, and the like. The current sensor 52 is installed in a path for supplying current to the motor 50 and detects an amount of current supplied to the motor 50 and outputs the detected amount of current to the control device 70. The current sensor 52 may be a dedicated sensing member, but may be formed with a substrate or the like that controls the motor 50.

The control device 70 is provided with a motor controller 71 and a heater controller 72 as functional configurations. The motor controller 71 controls driving of the motor 50. The heater controller 72 controls heating of the heater 23 in cooperation with the motor controller 71. Although not shown, the control device 70 further includes a laundry volume detector configured to detect an amount of laundry put into the drum 30, and a water supply controller or a drainage controller configured to control an operation of the water supply device 21 or the drainage device 22.

Operation of the Drum Type Washing Machine

Figure 5:
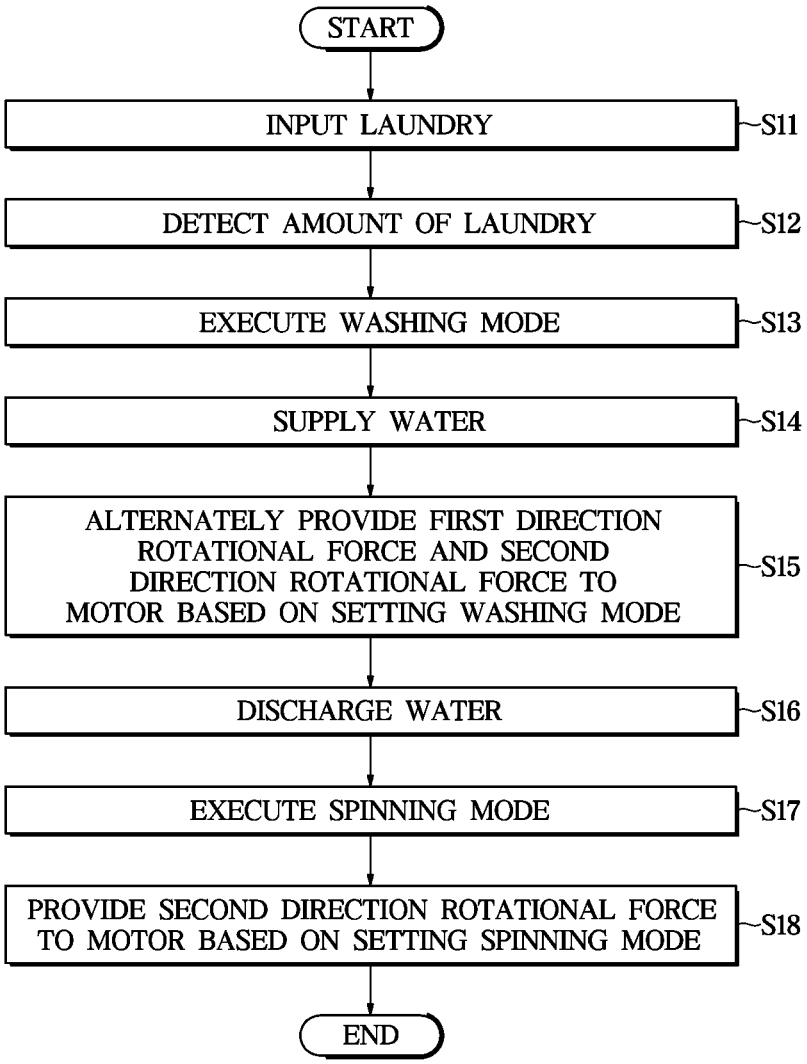
FIG. 5 is a flow chart illustrating an example of an operation of a drum type washing machine according to an embodiment of the disclosure.

FIG. 5 is a flow chart illustrating an example of an operation of the drum type washing machine according to an embodiment of the disclosure.

Referring to FIG. 5, as described above, the washing machine 1 executes a low rotation high torque washing mode corresponding to a "washing" or "rinsing" process, and a high rotation low torque spinning mode corresponding to a "spinning" process. In response to starting an operation of the washing machine by putting laundry into the drum 30 (operation 11), the control device 70 detects an amount of laundry (operation 12) and then executes the washing mode (operation 13), and subsequently, executes the spinning mode.

(Washing Mode)

In response to executing the washing mode, the control device 70 first operates the water supply device 21 (operation 14). Accordingly, a predetermined amount of water is supplied to the tub 20 based on the amount of laundry. In the washing process, detergent or the like is added to the tub 20 along with water supply. Only water supply is executed in the rinsing process.

The control device 70 (the motor controller 71) drives the motor 50 at a predetermined low speed while periodically switching a rotation direction for a predetermined period according to the amount of laundry (operation 15).

Figure 6:
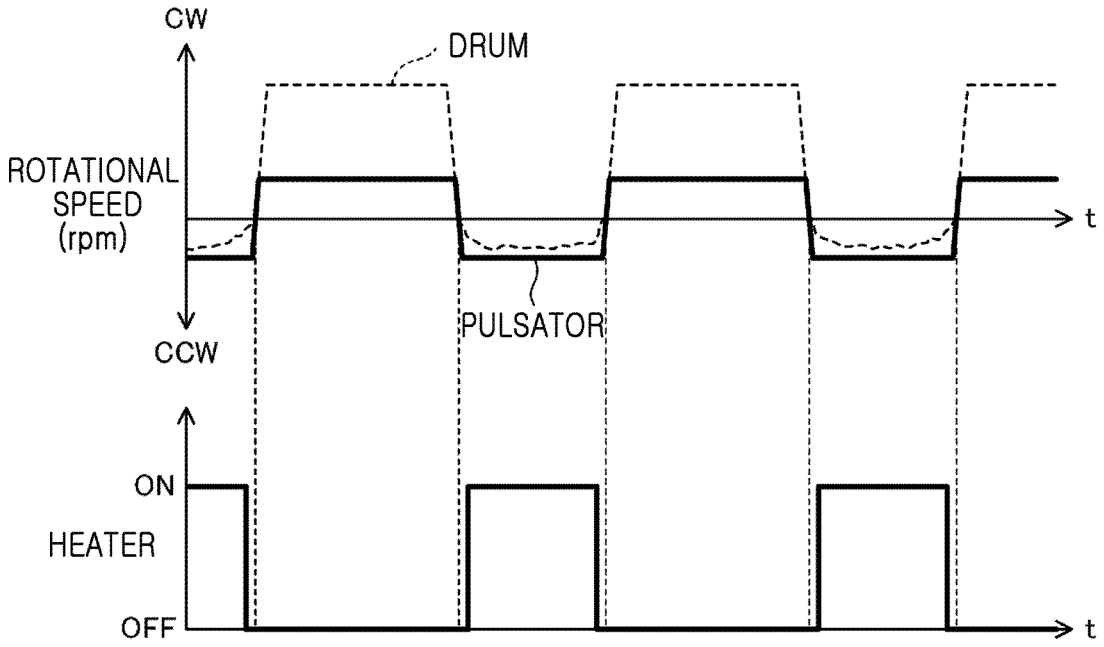
FIG. 6 is a view illustrating a time chart (upper view) of rotation direction and rotational speed of a drum and a pulsator and a time chart (lower view) of heater energization control corresponding thereto in response to executing a washing mode according to an embodiment of the disclosure.

FIG. 6 is a view illustrating a time chart (upper view) of rotation direction and rotational speed of a drum and a pulsator and a time chart (lower view) of heater energization control corresponding thereto in response to executing a washing mode according to an embodiment of the disclosure.

An upper view of FIG. 6 shows a time chart in response to executing the washing mode. A vertical axis represents a rotational speed in each direction of clockwise CW and counter clockwise CCW, a solid line represents a rotational speed of the drum 30, and a dotted line represents a rotational speed of the pulsator 40, respectively.

The drum 30 is decelerated according to the velocity ratio of the first drive transmission element, and alternately rotates in the CW direction and the CCW direction according to the driving of the motor 50.

On the other hand, the pulsator 40 rotates in a decelerated state according to the velocity ratio of the second drive transmission element in the CW direction, but the driving force is not transmitted by the clutch 64 and thus the pulsator 40 idles in the CCW direction. In response to the rotation of the motor 50 in the CCW direction, the pulsator 40 randomly rotates in the CCW direction by contacting laundry rotated in the in the CCW direction in the drum 30.

Because the drum 30 rotates to lift and drop laundry, it is possible to obtain an action of beating-washing, similar to the general drum type washing machine 1. In the CW direction, because the pulsator 40 rotates at a higher rotational speed than the drum 30, the action of the "scrubbing-washing" by the pulsator 40 is also added. Therefore, the cleaning effect is improved. Because the drum 30 and the pulsator 40 do not rotate only in the same direction, it is possible to prevent excessive mechanical action from being applied to the laundry. Further, it is possible to prevent entanglement of laundry.

In the washing machine 1, in order to increase the cleaning effect, a process of heating water stored in the tub 20 (process of heating water) is executed upon executing the washing mode. The process of heating water is performed in response to applying a current to the heater 23 by the control device 70 (the heater controller 72). At this time, the large amount of current is supplied to the heater 23.

Because the washing machine 1 rotationally drives both the drum 30 and the pulsator 40 by using the single motor 50, the large amount of current is supplied to the motor 50 upon driving the drum 30 and the pulsator 40 in the CW direction. Therefore, in response to the execution of the heater 23 in addition to the rotation in the CW direction, the amount of current is significantly increased at once and thus it may lead to lack of power.

On the other hand, upon rotationally driving in the CCW direction, only the drum 30 rotates, and thus the amount of current required to the motor 50 is less than that of the case of rotationally driving in the CW direction.

Therefore, in this washing machine 1, as shown in the lower view of FIG. 6, the control device 70 (the heater controller 72) controls the heater 23 to allow the energization of the heater 23 to be performed during a period in which the pulsator 40 is not rotationally driven (a period in which the pulsator 40 rotates in the CCW direction), and to allow the energization of the heater 23 not to be performed during a period in which the pulsator 40 is rotationally driven (a period in which the pulsator 40 rotates in the CW direction).

Therefore, because it is possible to prevent power consumption exceeding the rated power, it is possible to rotationally drive the drum 30 and the pulsator 40 while executing the process of heating water by using the single motor 50. The process of heating water is executed several times in the washing and rinsing during the control device 70 operates the drainage device 22 to change water in the washing mode. Referring to FIG. 5, finally, the washing mode is terminated by discharging the water stored in the tub 20 (operation 16).

(Spinning Mode)

In response to the termination of the washing mode, the spinning mode is executed (operation 17). The control device 70 (the motor controller 71) rotates the drum 30 at a predetermined high rotational speed in the CCW direction for a predetermined period (operation 18).

Figure 7:
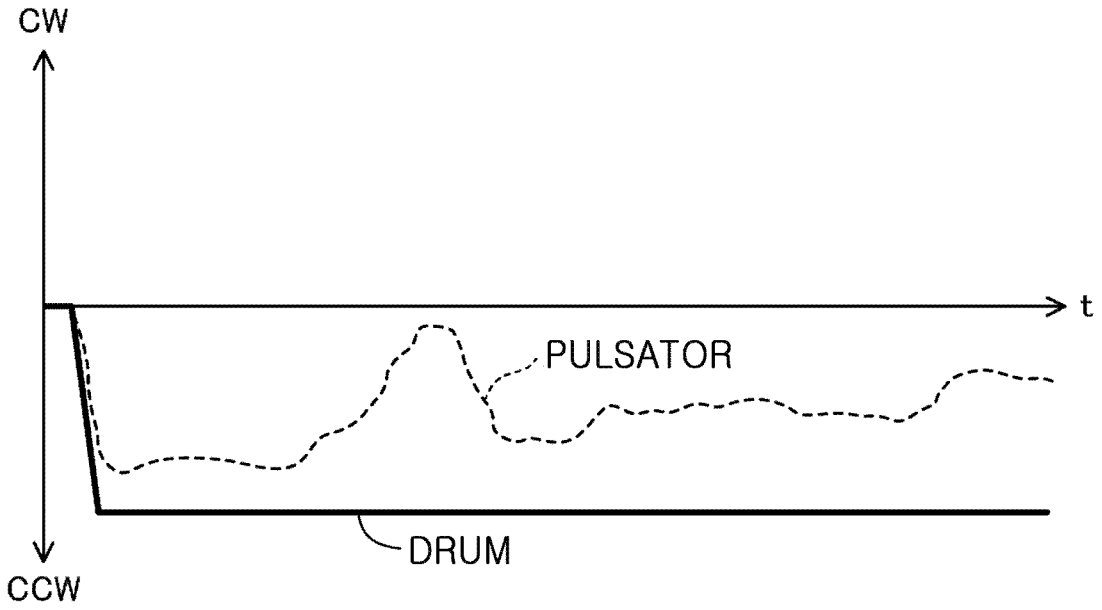
FIG. 7 is a view illustrating a time chart of rotation direction and rotational speed of a drum and the pulsator in response to executing a spinning mode according to an embodiment of the disclosure.

FIG. 7 illustrates a time chart in the execution of the spinning mode according to an embodiment of the disclosure.

Referring to FIG. 7, in the spinning mode, the rotational speed of the drum 30 is increased to a predetermined rotational speed at which laundry is stuck to the inner circumferential surface of the drum 30 by centrifugal force. Because the rotational speed of the drum 30 is decelerated according to the velocity ratio of the first drive transmission element, the motor 50 is driven at the high rotational speed.

By the execution of the spinning mode, water contained in the laundry is moved to the tub 20 through the through hole and then discharged by the drainage device 22. Accordingly, water in the laundry is removed.

The pulsator 40 idles because the driving force is not transmitted in the CCW direction by the clutch 64. That is, the pulsator 40 does not rotate or rotates according to the influence of the rotation resistance. The pulsator 40 randomly rotates in the CCW direction by the contact with the laundry rotating the inside of the drum 30 in the CCW direction. Even though the laundry is in contact with the pulsator 40, the pulsator 40 just rotates in synchronization with the laundry but does not apply a strong force to the laundry. Therefore, it is possible to prevent damage on the laundry.

(Laundry Entanglement Prevention Control)

In comparison with the drum type washing machine without the pulsator 40 according to the related art, the washing machine 1 may increase the mechanical action by including the pulsator 40, so as to increase the washing performance but it may lead to the entanglement of the laundry. The laundry is tangled and then stuck between the drum 30 and the pulsator 40, which may cause locking.

Because the washing machine 1 drives both the drum 30 and the pulsator 40 by using the single motor 50, the motor 50 is likely to be overloaded in response to locking of the laundry. Therefore, in order to stably secure high washing performance in the washing machine 1, it is appropriate to prevent the entanglement of the laundry.

Therefore, in the washing machine 1, the control of the motor 50 is revised to effectively prevent the entanglement of laundry in the washing mode. In the washing machine 1, a control for preventing entanglement of laundry (entanglement prevention control) is performed in two stages.

That is, a control (a first entanglement prevention control), which is to temporarily increase the rotational speed of the motor in response to a drive current of the motor 50 exceeding a reference value, and a control (a second entanglement prevention control), which is to temporarily reverse the rotation direction of the motor 50 in response to a drive current of the motor 50 not being less than the reference value despite of the first entanglement prevention control, are performed during the execution of the washing mode.

Figure 8:
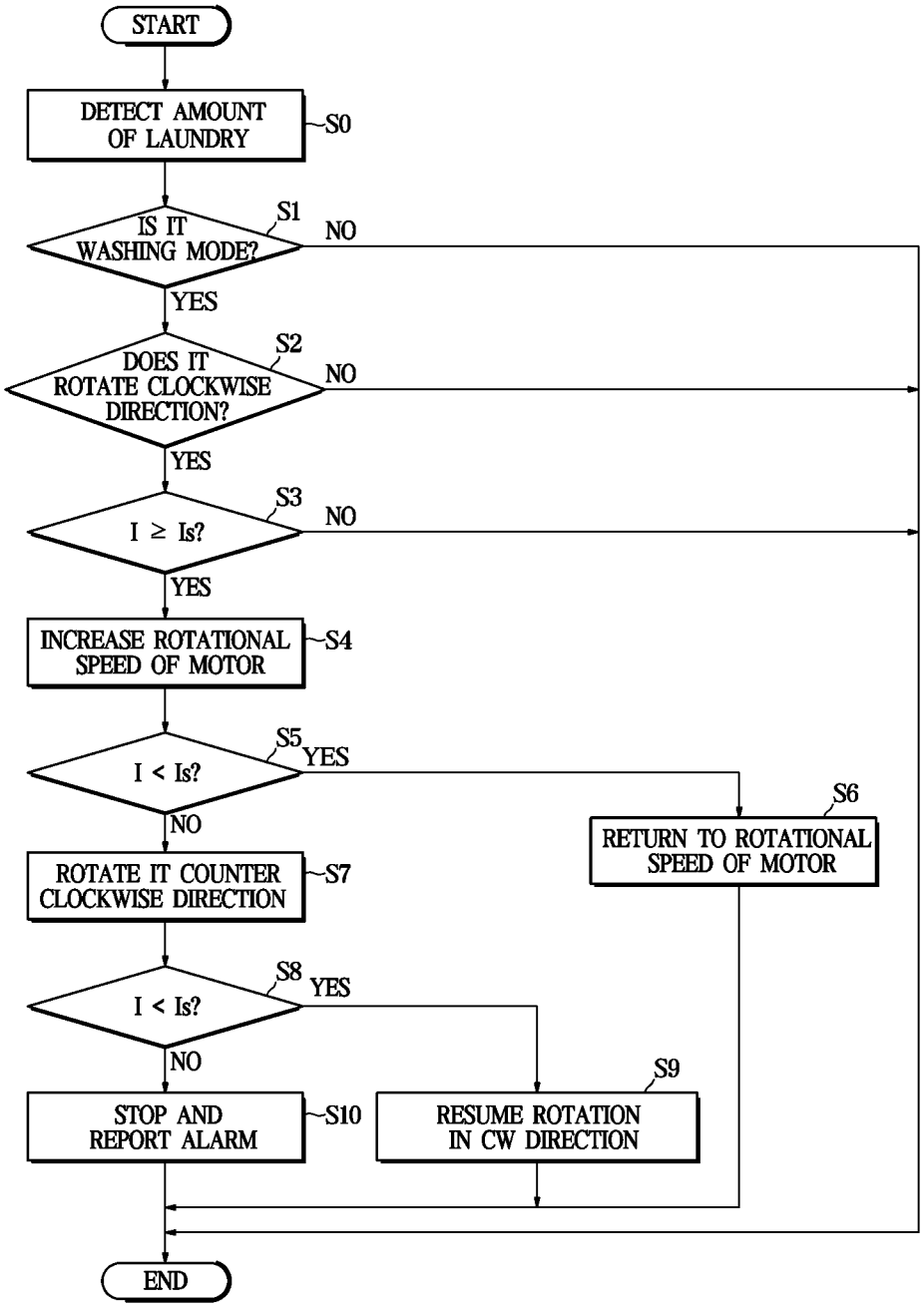
FIG. 8 is a flowchart illustrating an example of laundry entanglement prevention control according to an embodiment of the disclosure.

FIG. 8 illustrates an example of the laundry entanglement prevention control performed by a control device (a motor controller) according to an embodiment of the disclosure.

Referring to FIG. 8, as mentioned above, in the response to starting the operation of the washing machine 1, the control device 70 detects the amount of laundry using a centrifugal force (operation 0).

In the case of the washing machine 1, in particular, the motor 50 is more likely to be overloaded in response to the CW rotation of the motor 50 in the washing mode. Accordingly, the control device 70 determines whether or not the operation of the washing machine 1 is in the washing mode (operation 1), and whether or not the motor 50 rotates in the CW direction (operation 2).

In response to determination that the operation of the washing machine 1 is in the washing mode and the motor 50 rotates in the CW direction (yes in operation 1 and operation 2), the control device 70 determines whether or not a drive current value I of the motor 50 is equal to or greater than a predetermined reference value Is based on a detection value of the current sensor 52 (operation 3).

The reference value Is is a drive current value in a state in which the load of the motor 50 is higher than usual because the laundry starts to be tangled, and the reference value Is is pre-set in the control device 70 based on a test result or the like. For example, a value of about 70 to 90% of an upper value of the drive current of the motor 50 may be set as the reference value Is. The reference value Is may be changed according to the detected amount of laundry.

In response to the drive current value I being less than the predetermined reference value Is, the entanglement prevention control is not performed (no in operation 3) because the laundry is hardly tangled. On the other hand, in response to the drive current value I being equal to or greater than the predetermined reference value Is, the control device 70 executes a process of increasing the rotational speed of the motor 50 (the first entanglement prevention control) (operation 4). At this time, the rotational speed of the motor 50 may be defined as an entanglement prevention speed.

Accordingly, in response to increasing the rotational speed of the drum 30, the movement of the laundry in the drum 30 changes, such as a drop position of the laundry. Further, because the drum 30 and the pulsator 40 rotate at different rotational speeds in the CW direction, the mechanical action applied on the laundry changes as the rotational speed increases. Therefore, in a case in which entanglement of laundry is relatively loose, the entanglement may be loosened.

In response to loosening the entanglement of laundry, the drive current value I is reduced. Therefore, in response to the drive current value I being less than the reference value Is (yes in operation 5), the control device 70 executes a process of returning the rotational speed of the motor 50 (operation 6).

In response to failing in loosening the entanglement of laundry in the first entanglement prevention control (no in operation 5) that is the drive current value I is not less than the reference value Is, the control device 70 executes the process of temporarily reversing the rotation direction of the motor 50 (the second entanglement prevention control) (operation 7). That is, the control device 70 changes the rotation direction of the motor 50 from the CW direction to the CCW direction and drives the motor 50 for a predetermined period.

Because the laundry rotates in the opposite direction, the state of the laundry in the drum 30 changes greatly. Therefore, in the state in which the entanglement of laundry is moderate, the entanglement of laundry may be loosened.

In response to loosening the entanglement of laundry, the drive current value I is reduced. Therefore, in response to the drive current value I being less than the reference value Is (yes in operation 8), the control device 70 returns the rotation direction of the motor 50 to the CW direction and resumes the rotation (operation 9).

In response to failing in loosening the entanglement of laundry in the second entanglement prevention control that is the reference value Is is not reduced (no in operation 8), the motor 50 is overloaded and thus an appropriate processing may not be performed. Accordingly, the control device 70 stops the operation and reports an alarm (operation 10).

In the embodiment, an example in which the entanglement prevention control is performed in two stages is illustrated, but only one of the two stages may be executed. Further, a current value to determine the drive current value I is set as the same reference value Is, but it may also set individually. For example, in the second entanglement prevention control, an upper value of the drive current of the motor 50 may be used as the determination value.

Example of Improvement in Laundry Entanglement Prevention Control

In the above-described embodiment, an example of the control for loosening the entanglement by detecting the occurrence of entanglement of laundry is described. Particularly, the instantaneous drive current of the motor 50 is compared with the predetermined reference value Is, and in response to the instantaneous drive current of the motor 50 exceeding the reference value Is, the occurrence of entanglement of laundry is detected and then the rotational speed is increased or is temporarily reversed.

However, in this case, it is possible to prevent the motor 50 from being locked, but because an increase in the drive current is detected, it is difficult to cope with the difficulty of an increase in power consumption or vibration noise. In order to prevent the increase in power consumption or vibration noise, it is required to detect a precursor before the drive current increases, that is, before the motor 50 is overloaded.

(Contra-Rotation, and Same Direction-Different Speed Rotation)

In the washing mode, the rotation direction of the drum 30 and the pulsator 40 may be defined as the contra-rotation (rotation in directions opposite to each other) and the same direction-different speed rotation (rotation in the same direction and at different speed). In terms of the cleaning effect, the contra-rotation having excellent mechanical power may be appropriate. Therefore, in the washing mode, the rotation of the drum 30 and the pulsator 40 is the contra-rotation, generally.

However, in the case of the contra-rotation, the load of the motor 50 is large, and the fluctuation thereof is also rapid, and thus it is difficult to detect a precursor of the overload of the motor 50. In addition, the state of the laundry constantly changes and the entanglement of laundry rarely occurs because the rotation direction is switched in a relatively short time. However, the entanglement of laundry may suddenly and instantaneously occur.

Figure 9:
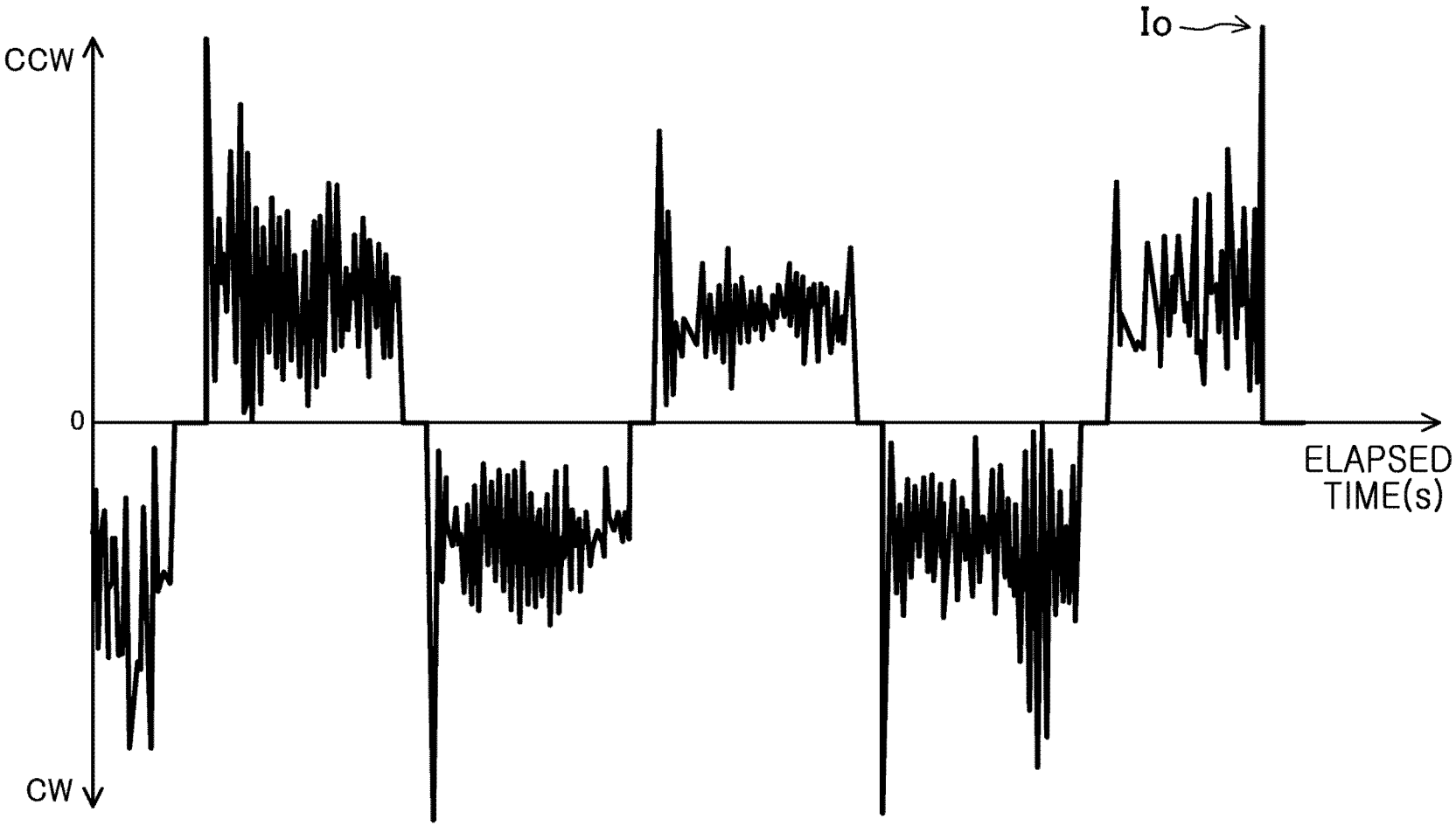
FIG. 9 is a graph illustrating a time change of drive current of a contra-rotating motor in a manner according to the related art.

FIG. 9 illustrates an example of time change of drive current of the motor in the contra-rotation according to the related art.

Referring to FIG. 9, in the contra-rotation, the drum and the pulsator are driven to rotate in opposite directions between the CW and CCW directions. Accordingly, the current value of the motor is large in each rotation direction, and the fluctuation range thereof is also large. In the contra-rotation, because the mechanical force is effectively applied to the laundry, the rotation direction between the CW and CCW directions is switched for a relatively short period of time. Accordingly, the large current value reverses again, and thus the fluctuation is also steep.

A large peak is observed in the drive current immediately after switching the rotation direction, which is a peak due to motor control, not due to motor overload. In an example in the drawing, a peak indicated by a symbol Io is an overload peak due to entanglement of laundry. In the counter-rotation, these peaks occur suddenly in both the CW and CCW directions.

Because the state of the laundry changes in response to reversing of the rotation direction, it is required to detect the precursor of the overload of the motor before the rotation direction is reversed. However, it is difficult to detect the precursor of the overload of the motor because a period for detecting the precursor is short and the fluctuation of the drive current is large.

On the other hand, in the same direction-different speed rotation, the mechanical action is weaker than the contra-rotation. Accordingly, the load of the motor is relatively small and the change is also gentle. The laundry condition in the drum is also relatively stable. Therefore, the entanglement of laundry also tends to occur relatively gently and gradually.

As a result of review by designers with focusing on this point, a change corresponding to the precursor is observed in the change in the drive current of the motor 50 that is measured over a predetermined period of time before the overload of the motor 50 due to laundry entanglement occurs. This example of improvement is based on this observation.

Particularly, in the case of the washing machine 1, during the washing mode using the clutch 64 is executed, the switching process is alternately executed in two rotation directions such as the CW direction and the CCW direction, which have different mechanical actions on the laundry.

Particularly, a process (high-load rotation process) in which the drum 30 rotates at a predetermined speed in the CW direction (forward rotation direction) while the pulsator 40 rotates at a higher speed than the drum 30, and a process (low-load rotation process) in which the drum 30 rotates at a predetermined speed in the CCW direction (opposite direction) while the pulsator 40 idles are alternately performed for a predetermined driving period. Usually, the length of each driving period is constant.

Therefore, as shown in FIG. 6, generally, the high-load rotation process having a large mechanical action is set to have a longer process time than the low-load rotation process having a small mechanical action so as to improve the washing performance. A ratio of such process time (high-load rotation process time:low-load rotation process time) may be in a range of 6:4 to 9:1. It is appropriate that the ratio of process time is 7:3 or more and 8:2 or less. In this washing machine 1, the ratio of process time is set to 7:3.

The overload of the motor 50 is likely to occur in the CW direction in which the high-load rotation process is performed. Because the driving period thereof is long, it is possible to stably measure the amount of change in the drive current of the motor 50 over a relatively long period of time.

Figure 10:
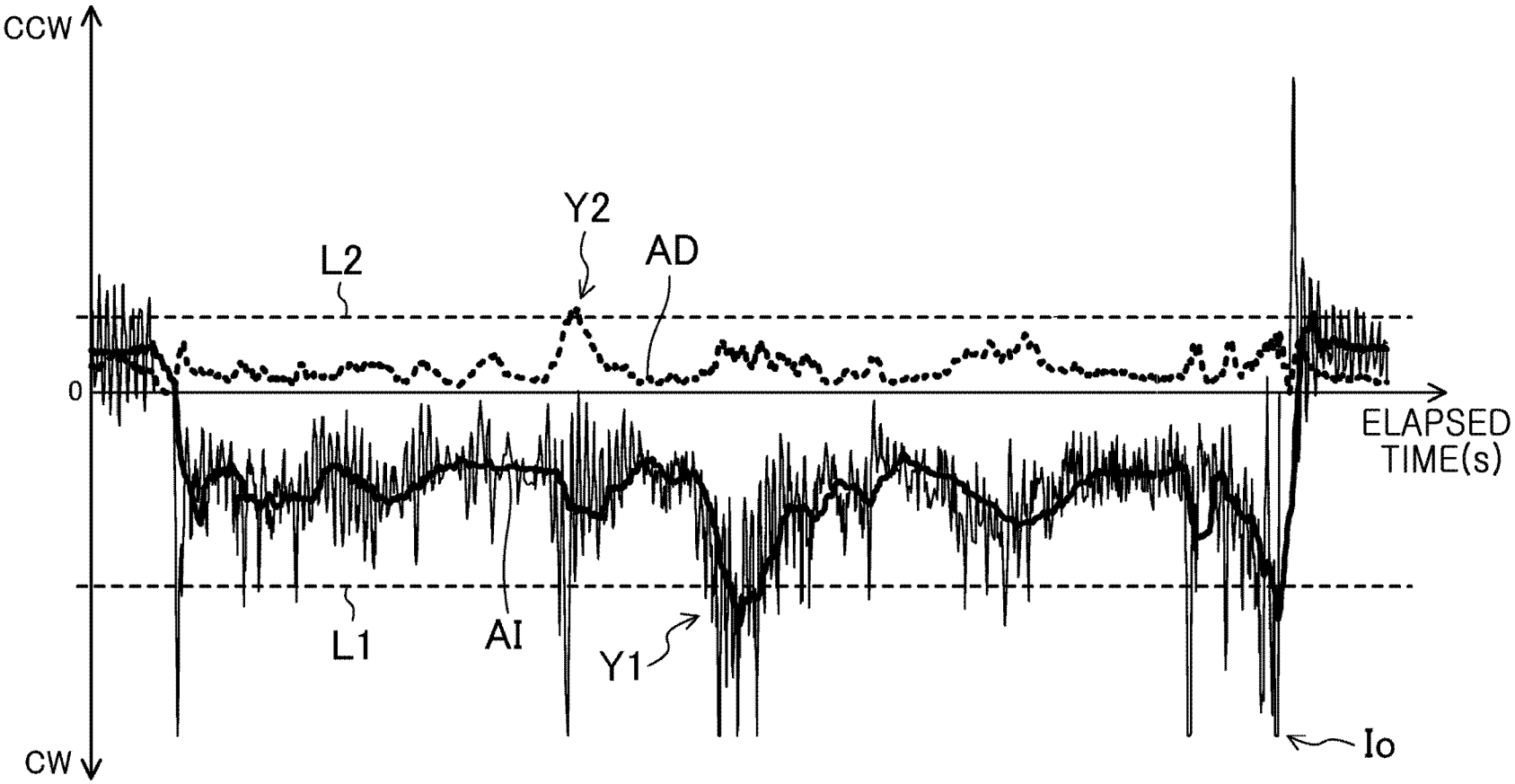
FIG. 10 is a graph illustrating an example of a time change of drive current of motor according to an embodiment of the disclosure.

FIG. 10 illustrates an example of the time change of drive current of a motor in the washing machine 1 according to an embodiment of the disclosure. Particularly, FIG. 10 illustrates the rotation in the CW direction that is the high-load rotation process. As described above, the ratio of the driving period of the high-load rotation process and the low-load rotation process is 7:3, and most of the washing modes are operated by the high-load rotation process.

Referring to FIG. 10, a thick solid line graph indicated by a symbol AI represents a change in time of an average current value (first comparison value) obtained by averaging the drive current values in a predetermined period. A dotted line graph indicated by a symbol AD represents a change in time of an average deviation value (second comparison value) obtained by averaging absolute values of the deviation of the drive current values in a predetermined period. The average current value and the average deviation value correspond to a comparison value with respect to the amount of change in the drive current of the motor 50 measured for the predetermined period.

Particularly, the predetermined period may be a period in which the drum 30 rotates 1 to 3 times. The predetermined period is appropriately set according to the specifications of the washing machine 1. In response to the predetermined period being significantly short or significantly long, it becomes difficult to detect the precursor of occurrence of overload of the motor 50. The average current value and the average deviation value are calculated by the control device 70 based on the value of the drive current of the motor 50 measured by the current sensor 52 for the period.

The control device 70 may obtain an average current value by calculating an average value based on a plurality of drive current values input in a predetermined period. In addition, the control device 70 may calculate a deviation (absolute value) of two drive current values that is input before and after and then calculate an average value from the deviation, thereby obtaining an average deviation value. At this time, this average value may be an arithmetic average, but a moving average is appropriate.

In the case of washing by the same direction-different speed rotation, it is possible to detect the precursor of occurrence of the overload of the motor 50 according to a comparison value with respect to the amount of change in the drive current of the motor 50 measured for the predetermined period.

Referring to FIG. 10, a line indicated by a symbol L1 represents a first threshold value (a predetermined value) set for an average current value. A line indicated by a symbol L2 represents a second threshold value (a predetermined value) set for the average deviation value. These threshold values are appropriately set according to the specifications of the washing machine 1.

For example, referring to FIG. 10, a peak indicated by a symbol Io represents a peak of the overload due to the entanglement of laundry. At a timing indicated by an arrow Y1, an average current value exceeds the first threshold value, which is the precursor of the overload. Therefore, at this timing, it is possible to determine the presence or absence of the precursor of the overload occurring thereafter.

Similarly, at a timing indicated by an arrow Y2, an average deviation value exceeds the second threshold value, which is the precursor of the overload. Therefore, at this timing, it is possible to determine the presence or absence of the precursor of the overload occurring thereafter. In response to detecting the precursor, it is possible to execute a temporary low load rotation process for a predetermined period, thereby preventing the entanglement of laundry in advance. As a result, it is possible to effectively prevent the overload of the motor 50, thereby preventing the increase in power consumption and vibration noise as well as preventing the locking of the motor 50.

(Specific Example of Overload Prevention Control)

Figure 11:
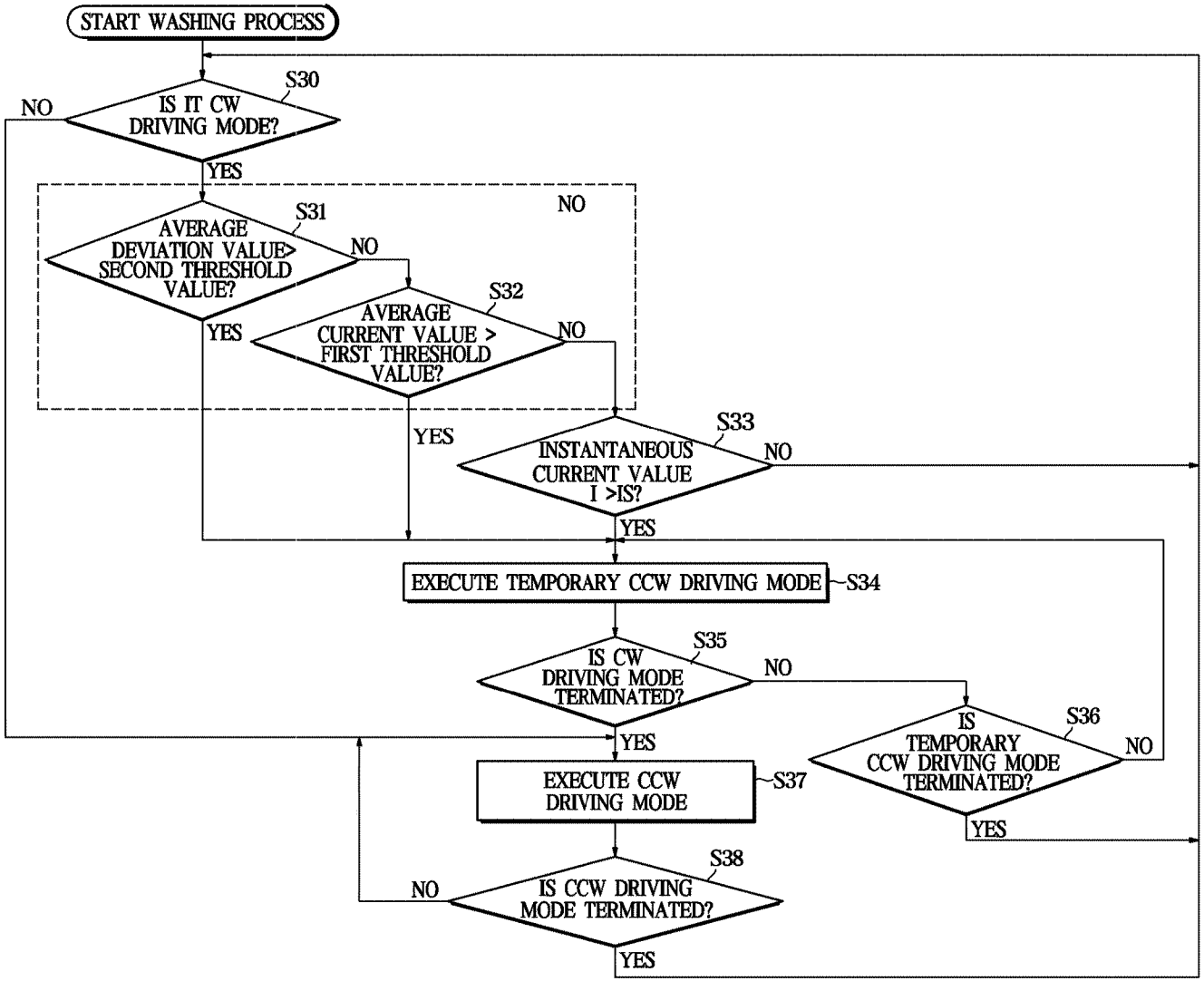
FIG. 11 is a flow chart illustrating an example of motor overload prevention control according to an embodiment of the disclosure.

FIG. 11 illustrates a specific example of overload prevention control performed by the control device of a washing machine according to an embodiment of the disclosure.

Figure 12:
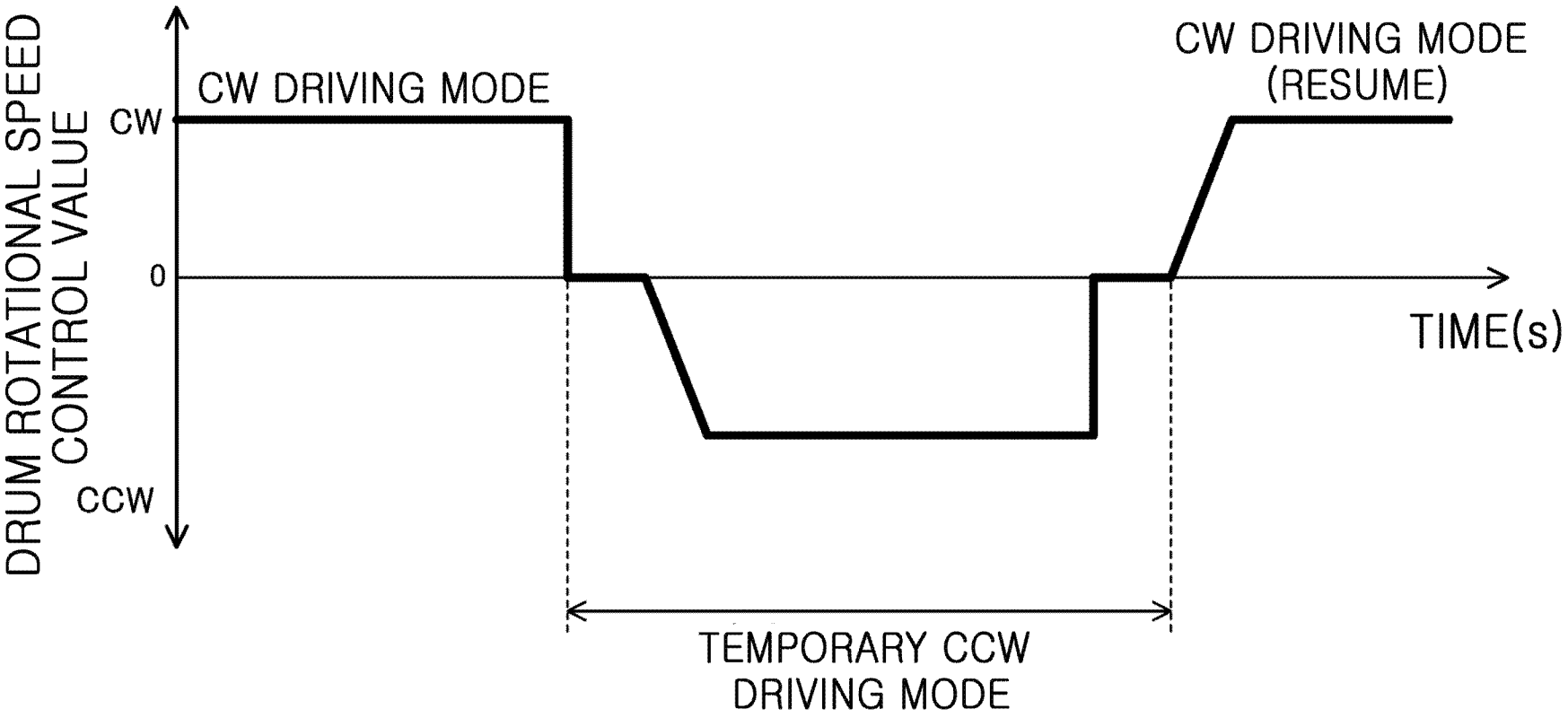
FIG. 12 is a view illustrating a time chart of drum rotational speed control value in the overload prevention control according to an embodiment of the disclosure.

FIG. 12 illustrates the time change of a control instruction value (drum rotational speed control value) for controlling the rotational speed of a drum according to an embodiment of the disclosure.

Referring to FIG. 11, in the case of the washing machine 1 and drum 30, the overload of the motor 50 is likely to occur during the high load rotation process in which the motor 50 rotates in the CW direction in the washing mode. Therefore, the control device 70 determines whether the washing machine 1 is in the washing mode and whether the motor 50 rotates in the CW direction (CW driving mode) (operation 30).

In the case of the CW driving mode, the control device 70 executes the control for detecting the precursor of the overload prior to the entanglement prevention control. That is, the control device 70 continuously calculates the average current value and the average deviation value during execution of the CW driving mode. The control device 70 continuously determines whether or not the average deviation value exceeds the second threshold value (operation 31). Therefore, in response to the average deviation value exceeding the second threshold value, the control device 70 determines that the precursor of the overload is present, and the control device 70 executes the temporary low load rotation process (temporary CW driving mode) (operation 34).

On the other hand, in response to the average deviation value not exceeding the second threshold value, the control device 70 continuously determines whether or not the average current value exceeds the first threshold value (operation 32). Therefore, in response to the average current value exceeding the first threshold value, the control device 70 determines that the precursor of the overload is present, and the control device 70 executes the temporary low load rotation process (the temporary CW driving mode) (operation 34).

The presence of the precursor of the overload of the motor is determined depending on whether at least one of the average current value and the average deviation value exceeds the corresponding threshold value. Only one value may be used for the determination, but it is possible to more stably detect the precursor of the overload by combining both values. At this time, the order of operations 31 and 32 may be reversed.

On the other hand, in response to the average current value not exceeding the first threshold value, the control device 70 executes the aforementioned entanglement prevention control. In other words, the control device 70 determines whether not the instantaneous drive current of the motor 50 exceeds the predetermined value (the reference value Is) (operation 33). The control device 70 executes the temporary CW driving mode as the second entanglement prevention control (operation 34). Before that, the control device 70 may execute the first entanglement prevention control.

The temporary CCW driving mode is a driving mode temporarily executed during the CW driving mode to prevent the overload of the motor 50. That is, in the temporary CCW driving mode, the rotation direction of the motor 50 is switched from the CW direction to the CCW direction and is operated for a predetermined period, which is similar to the second entanglement prevention control. In the low-load rotation process rotating in the CCW direction, the mechanical action is weak, and thus power consumption is low and noise or vibration is also low. Therefore, it is possible to gently loosen the entanglement of laundry.

Particularly, referring to FIG. 12, in response to starting the temporary CCW driving mode, the control device 70 sets a drum rotational speed control value in the CW driving mode to 0 (zero) for the motor 50. After a predetermined waiting time in consideration of rotation due to the inertia of the drum 30, the control device 70 starts the CCW driving with the drum rotational speed control value of the CCW driving mode. The control device 70 operates the CCW driving mode for the predetermined period. The driving period of the temporary CCW driving mode is set in advance according to the specifications of the washing machine 1.

Referring to FIG. 11, the control device 70 determines termination of the driving period of the CW driving mode in the meantime (operation 35), and in response to the termination of the temporary CCW driving mode during the driving period of the CW driving mode (yes in operation 36), the control device 70 resumes the CW driving mode.

Particularly, as illustrated in FIG. 12, the control device 70 sets a drum rotational speed control value in the CCW driving mode to 0 (zero). After a predetermined waiting time, the control device 70 starts the CW driving with the drum rotational speed control value of the CW driving mode, and resumes the CW driving mode. The cleaning effect is excellent because the mechanical power is stronger in the CW driving mode. Therefore, if it is possible to prevent the overload in advance by executing the temporary CCW driving mode, it is possible to prevent deterioration of the cleaning effect by resuming the CW driving mode.

On the other hand, in response to the termination of the operation time of the CW driving mode during the temporary CCW driving mode (yes in operation 35), the control device 70 executes a normal CCW driving mode following the temporary CCW driving mode (operation 37). It is possible to reduce the power consumption and to secure the driving stability. In response to the termination of the normal CCW driving mode, the control device 70 normally switches to the CW driving mode (yes in operation 38).

As mentioned above, it is possible to effectively prevent the overload of the motor 50 by executing the overload prevent control. As a result, it is possible to prevent the locking of the motor 50 in advance, and to prevent the increase in power consumption and vibration noise.

In addition, the drum-type washing machine according to the disclosed technology is not limited to the above-described embodiment, and may include various other configurations.

For example, in the above-described embodiment, heating is performed by the heater at the execution of the washing mode, but heating by the heater may not be performed. In addition, during the execution of the washing mode, the rotation direction of the motor is periodically switched, but the motor may rotate only in the CW direction or the CCW direction. In the case of rotating only in the CCW direction, it is possible to reduce mechanical force and thus it is appropriate for washing delicate clothes.

The switching timing of the rotation direction may be appropriately changed according to specifications. For example, because a magnitude of the mechanical action on laundry is different in the CW direction and the CCW direction (CW direction>CCW direction) in the washing mode, it is possible to increase the cleaning effect by relatively increasing the rotation time in the CW direction. Conversely, by relatively increasing the rotation time in the CCW direction, it is possible to perform washing to reduce mechanical damage to laundry. Accordingly, it is possible to set various driving modes such as a time reduction mode or a soft washing mode.

As is apparent from the above description, the drum-type washing machine may reduce the weight thereof and improve the washing performance at low cost.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A drum-type washing machine comprising:

a body comprising an inlet formed on a front side;

a tub accommodated in the body;

a drum configured to be rotatable inside the tub;

a pulsator configured to be rotatable inside the drum;

a motor configured to generate first direction rotational force and second direction rotational force opposite to the first direction rotational force for rotating the drum and the pulsator;

a first drive transmission element configured to transmit the first direction rotational force and the second direction rotational force generated by the motor to the drum;

a second drive transmission element configured to transmit the first direction rotational force generated by the motor to the pulsator, and comprising a clutch configured to transmit the first direction rotational force and configured to block transmission of the second direction rotational force; and a processor configured to:

control the motor to switch between the first direction rotational force and the second direction rotational force in response to a change of an operating mode.

2. The drum-type washing machine of claim 1, wherein the processor is further configured to control the motor to transmit the second direction rotational force to the drum in response to the operating mode being set as a spinning mode, the spinning mode configured to increase to a predetermined rotational speed at which laundry is stuck to an inner circumferential surface of the drum by centrifugal force.

3. The drum-type washing machine of claim 1, wherein in response to a drive current of the motor exceeding a reference value, the processor is further configured to allow a rotational speed of the motor to be increased and to reach an entanglement prevention speed.

4. The drum-type washing machine of claim 3, wherein the processor is further configured to reverse a rotation direction of the motor in response to the motor rotating at the entanglement prevention speed and the drive current of the motor being not less than the reference value.

5. The drum-type washing machine of claim 1, wherein the first drive transmission element comprises a first driving pulley removably coupled to the motor, and wherein the second drive transmission element comprises a second driving pulley removably coupled to the motor.

6. The drum-type washing machine of claim 1, wherein the first drive transmission element is configured to provide greater deceleration of a rotation output by the motor than the second drive transmission element.

7. The drum-type washing machine of claim 1, wherein in response to the operating mode being set as a washing mode, the processor is further configured to control the motor to alternately provide the first direction rotational force and the second direction rotational force and control the motor to allow a period for providing the first direction rotational force to be longer than a period for providing the second direction rotational force.

8. The drum-type washing machine of claim 7, wherein in response to a drive current of the motor, which is measured while the motor provides the first direction rotational force, exceeding a threshold value, the processor is further configured to control the motor to provide the second direction rotational force.

9. The drum-type washing machine of claim 8, wherein the processor is further configured to control the motor to provide the first direction rotational force after the motor provides the second direction rotational force for a predetermined period.

10. The drum-type washing machine of claim 8, wherein the processor is further configured to determine a presence or absence of a precursor of overload of the motor by comparing a first comparison value, which is obtained by averaging a drive current value in a predetermined period of the motor, or a second comparison value, which is obtained by averaging an absolute value of a deviation of a drive current value in the predetermined period, with the threshold value.

11. The drum-type washing machine of claim 10, wherein the predetermined period is set as a period in which the drum rotates 1 to 3 times.

12. The drum-type washing machine of claim 7, wherein a ratio of a time in which the motor provides the first direction rotational force and a time in which the motor provides the second direction rotational force is set as 7:2 or more and 8:2 or less.

13. A drum-type washing machine comprising:

a body comprising an inlet formed on a front side;

a tub accommodated in the body;

a drum configured to be rotatable inside the tub;

a pulsator configured to be rotatable inside the drum;

a motor configured to provide a rotational force for rotating the drum and the pulsator;

a first drive transmission element configured to connect the motor to the drum;

a second drive transmission element configured to:

connect the motor to the pulsator in response to providing a first direction rotational force by the motor, and release a connection between the motor and the pulsator in response to providing a second direction rotational force, which is opposite to the first direction rotational force, by the motor; and a processor configured to:

control the motor in response to an operating mode that is set, control the motor to provide the first direction rotational force and the second direction rotational force in response to setting a washing mode, and control the motor to provide the second direction rotational force in response to setting a spinning mode.

14. The drum-type washing machine of claim 13, wherein in response to a drive current of the motor exceeding a reference value, the processor is further configured to allow a rotational speed of the motor to be increased to reach an entanglement prevention speed.

15. The drum-type washing machine of claim 14, wherein the processor is further configured to reverse a rotation direction of the motor in response to the drive current of the motor being not less than the reference value.

16. The drum-type washing machine of claim 13, wherein in response to setting the washing mode, the processor is further configured to the motor to allow a period for providing the first direction rotational force to be longer than a period for providing the second direction rotational force.

17. The drum-type washing machine of claim 13, wherein the second drive transmission element comprises a clutch configured to selectively connect the motor to the pulsator.

* * * * *